US007562699B2

(12) United States Patent
Bourgault et al.

(10) Patent No.: US 7,562,699 B2
(45) Date of Patent: Jul. 21, 2009

(54) REVERSING CIRCULATION FOR HEATING AND COOLING CONDUITS

(75) Inventors: Claude Bourgault, St. Brieux (CA); Larry Dancey, Melfort (CA)

(73) Assignee: Dryair Inc., St. Brieux, Saskatchewan (CA)

( * ) Notice: Subject to any disclaimer, the term of this patent is extended or adjusted under 35 U.S.C. 154(b) by 620 days.

(21) Appl. No.: 11/137,511

(22) Filed: May 26, 2005

(65) Prior Publication Data

US 2006/0060661 A1 Mar. 23, 2006

(30) Foreign Application Priority Data

Aug. 26, 2004 (CA) ..... 2479720

(51) Int. Cl.
*F25D 23/12* (2006.01)
*F28F 13/00* (2006.01)

(52) U.S. Cl. ..... 165/267; 62/238.6; 62/324.6

(58) Field of Classification Search ..... 165/45, 165/56, 200, 236, 256, 265, 267; 62/238.6, 62/324.6; 237/8 R, 12.3 A, 12.3 B, 12.3 R, 237/80

See application file for complete search history.

(56) References Cited

U.S. PATENT DOCUMENTS 3,587,726 A * 6/1971 Leonard ..... 165/267
3,680,629 A * 8/1972 Gaudreau et al. ..... 165/265
3,693,707 A * 9/1972 Richter ..... 165/267
3,735,805 A * 5/1973 Stillhard ..... 165/256
3,777,807 A * 12/1973 Carroll ..... 165/267
3,794,026 A * 2/1974 Jacobs ..... 128/200.13
4,312,372 A * 1/1982 Amos et al. ..... 137/266
4,416,194 A * 11/1983 Kemp ..... 165/267
4,479,352 A * 10/1984 Yamaoka et al. ..... 60/652
4,693,089 A * 9/1987 Bourne et al. ..... 62/238.6
5,062,736 A * 11/1991 Katsuragi et al. ..... 165/45
5,120,158 A * 6/1992 Husu ..... 405/43
5,181,655 A * 1/1993 Bruckelmyer ..... 165/45
5,226,471 A * 7/1993 Stefani ..... 165/200
5,533,568 A * 7/1996 Schuster et al. ..... 165/267
5,567,085 A 10/1996 Bruckelmyer
5,588,641 A * 12/1996 Sand ..... 267/119
5,746,831 A * 5/1998 Allen et al. ..... 239/690
5,875,644 A * 3/1999 Ambs et al. ..... 62/324.6
5,937,665 A * 8/1999 Kiessel et al. ..... 62/324.6
5,944,045 A * 8/1999 Allen et al. ..... 137/240
5,964,402 A * 10/1999 Jakobson ..... 165/45
6,761,135 B1 * 7/2004 Becktold ..... 237/80
6,991,028 B2 * 1/2006 Comeaux et al. ..... 165/236

(Continued)

*Primary Examiner*—Ljiljana (Lil) V Ciric
(74) *Attorney, Agent, or Firm*—Nixon & Vanderhye P.C.

(57) ABSTRACT

A fluid circulating apparatus for warming or cooling a surface includes a pressurized fluid source operative to circulate fluid through a conduit such that a supply fluid moves from a supply port of the fluid source into a first end of the conduit, through the conduit, and from a second end of the conduit to a return port of the fluid supply. A flow control when in a forward mode directs fluid from the supply port into the first end of the conduit and from the second end of the conduit to the return port, and when in a reverse mode directs fluid from the supply port into the second end of the conduit and from the first end of the conduit to the return port. A mode selector is operative to switch the flow control between forward mode and reverse mode.

9 Claims, 2 Drawing Sheets

U.S. PATENT DOCUMENTS 7,162,987 B2 * 1/2007 Bourgault et al. ..... 237/8 R
7,222,801 B2 * 5/2007 Meirana et al. ..... 165/56
7,401,742 B2 * 7/2008 Dancey et al. ..... 237/12.3 B
7,407,003 B2 * 8/2008 Ross ..... 165/45
7,409,986 B2 * 8/2008 Lee et al. ..... 165/267

* cited by examiner

REVERSING CIRCULATION FOR HEATING AND COOLING CONDUITS

This invention is in the field of heating and cooling equipment, particularly such equipment comprising fluid circulating in conduits.

BACKGROUND

It is well known to circulate a fluid from a pressurized fluid source, such as hot water for example, through a conduit arranged on or under a surface in order to heat the surface. Building heating systems are known where the conduit is arranged in loops such that the conduit passes back and forth at a spacing of a few inches, and hot water is circulated through the conduit. In a typical application the conduit can be embedded in a concrete floor, or arranged inside a radiant heating panel. Several radiant heating panels are sometimes connected in series such that the fluid circulates a considerable distance before returning to the boiler.

Such systems in a portable configuration are also used in construction projects, for example when thawing frozen ground and curing concrete. Where winter temperatures fall below freezing, ground must often be thawed prior to construction to facilitate excavation. Concrete must also be kept at temperatures above freezing in order to cure properly.

For portable applications such as ground thawing and curing concrete, flexible hoses are typically laid out in a back and forth pattern on the surface, with a spacing of 12-24". When curing concrete it is also known to embed the hoses in the concrete to increase efficiency by better retaining and distributing the heat in the concrete. These hoses then remain in the finished concrete and are sacrificed, or in some cases are used to heat the finished building by circulating hot water through them. Such a system is described for example in U.S. Pat. No. 5,567,085 to Bruckelmyer.

In typical use, the hose will be from 300 to 1500 feet in length, depending on the ambient temperature, the size of the area to be thawed, the capacity of the boiler, and like considerations. Typically the hoses and the surface being heated will be covered with insulated membranes to retain the heat on the surface. The rate of heating will vary but as an example, ground may typically be thawed at a rate of about one foot of depth per day.

In a typical ground thawing application, fluid at a temperature of 170°-190° F. is pumped from a boiler into the inlet end of the hose, through the looped hose and from the outlet end of the hose back to the boiler. Radiant heat from the fluid passing through the hose is transferred to the surrounding ground or concrete surface. As the fluid flows through the hose, the transfer of heat to the surrounding grounds results in a progressive reduction in the temperature of the fluid at any particular point along the path of flow, such that the fluid exiting the outlet end of the hose will be at a much reduced temperature as low as 80° F.

Since heat transfer is dictated by the difference in temperature between the fluid in the hose and the surrounding ground, the area near where the hot fluid enters the inlet end of the hose at about 180° F. receives more heat than the area near where the cooled fluid exits the outlet end of the hose at 80° F. and returns to the boiler. The end result is that a surface near the inlet end of the hose receives more heat than a surface near the supply end of the hose, and a temperature gradient is induced across the area covered by the hose.

Maintaining the temperature of concrete at a satisfactory level during curing presents increased challenges compared to thawing ground. The American Society for Concrete Contractors recommends that the temperature of the concrete be maintained between 50 and 70° F. As concrete initially contains a significant amount of moisture, it is subject to freezing, which inhibits the initial setting process. In addition, even once the initial setting process has occurred, concrete must be further cured in order that the concrete will achieve its intended strength. Ambient temperature need not even be below freezing in order to comprise the curing process In areas that experience high ambient temperatures, the concrete may dry too quickly. As happens with concrete that freezes before curing, concrete that is too warm dries too quickly and so suffers from reduced strength and is subject to cracking. In hot climates, ice is sometimes mixed with the concrete to reduce the temperature. Also it is known to circulate carbon dioxide gas through conduits similar to the fluid loops described above in order to cool the concrete.

Proper curing of concrete can affect the final strength by several-fold, and so significant attention is paid to maintaining a desirable temperature and level of hydration of the freshly poured concrete in order that the curing process will be the most effective, and the finished concrete product will display the highest degree of strength. It is thus recommended that fluid line temperatures in a fluid loop system be kept at between 70 and 80° F. while curing concrete.

Since the optimum temperature range for curing concrete is quite narrow compared to a ground thawing application, the difference in the inlet and outlet temperatures of fluid in hoses for curing concrete should be kept to a minimum. Temperature gradients within a slab of concrete result in different curing rates that lead to the creation of physical stress points within the concrete which can manifest as cracks and reduce the overall strength and quality of the concrete Decreasing the time the fluid is in the hoses or conduits can result in a reduced temperature gradient. To reduce this time the pressurized fluid source is typically connected to supply and return manifolds, and then a plurality of shorter hoses are connected to the manifolds in order to reduce the length of the hoses and thus reduce the temperature drop in the hoses. Also the inlet end of one hose, carrying warmer fluid, can be arranged beside the outlet end of another hose in an attempt to even out the heat transfer. The hoses however must be long enough to reach the farthest end the surface being heated in order to avoid the need for multiple boilers arranged around the surface. Thus instead of a single temperature gradient across the surface, a number of the temperature gradients are created across the surface, and the temperature gradient typically remains significant.

Such manifolds are used as well in permanent applications where a number of radiant heating panels or floor heating sections are each connected to the manifolds such that the length of the circulation path and the resulting temperature drop in the circulating fluid is reduced.

In a portable application, the hoses may also be re-arranged during the process in order to place the hottest portion of the hoses near material that to that point had been near the cooler portion of the hoses and was heating more slowly. This solution requires considerable effort and expense in placing and re-placing the hoses in various patterns required as the operation proceeds, and becomes more problematic when thousands of feet of tubing have to be arranged, a situation common in larger construction projects.

Thus in typical ground thawing applications, where the aim is simply to thaw the ground to the required depth, the apparatus is often simply operated until the entire area of interest is thawed to the desired extent. The result is that by the time the area near the outlet is thawed to the required depth, the area near the inlet is typically thawed to depth much greater than is required. Considerable energy and operational time is therefore wasted.

The longer any particular pocket of fluid is exposed to the surface being heated, the more the temperature of that pocket of fluid will drop. Moving the fluid through the hoses faster means that any particular pocket is exposed for a reduced time, resulting is less temperature drop. The fluid pressure can be increased in order to decrease the time it takes to flow through the hose, however higher pressures require more costly pumps and hoses that are adapted to handle the increased pressure. Such hoses are also not as flexible as lower pressure hoses, and are more difficult to handle and arrange in portable applications. Leaks in a high pressure system could also pose a safety risk.

Similarly increasing the diameter of the hoses means more fluid is exposed to the surface, with the result that less heat is taken out of any individual pocket of fluid, and a reduced temperature gradient can be achieved. Large hoses also allow the fluid to flow faster as with increased pressure. Again such larger hose is more costly than a similar length of smaller diameter hose, as well as being more difficult to transport and handle.

SUMMARY OF THE INVENTION

It is an object of the present invention to provide a circulating fluid conduit system for heating and cooling that overcomes problems in the prior art.

The invention provides, in one embodiment, a flow reversing apparatus for a circulating fluid system comprising a pressurized fluid source operative to circulate fluid through a conduit such that a supply fluid moves from a supply port of the fluid source into a first end of the conduit, through the conduit, and from a second end of the conduit to a return port of the fluid supply. The apparatus comprises a flow control adapted for operative connection to the supply and return ports of the fluid source, and to the first and second ends of the conduit. The flow control is operative, in a forward mode, to direct fluid from the supply port of the fluid source into the first end of the conduit and from the second end of the conduit to the return port of the fluid source, and is operative, in a reverse mode, to direct fluid from the supply port of the fluid source into the second end of the conduit and from the first end of the conduit to the return port of the fluid source. A mode selector is operative to switch the flow control between forward mode and reverse mode.

In a second embodiment the invention provides a circulating fluid apparatus for adjusting a temperature of a material. The apparatus comprises a pressurized fluid source operative to adjust a temperature of a fluid and operative to push the fluid out through a supply port at a supply temperature and operative to draw fluid in through a return port at a return temperature. A flow control is operatively connected to the supply port and the return port of the fluid source. A conduit has a first end operatively connected to the flow control and a second end operatively connected to the flow control and is adapted to be arranged in proximity to the material. The flow control is operative, in a forward mode, to direct fluid from the supply port of the fluid source into the first end of the conduit and from the second end of the conduit to the return port of the fluid source such that fluid circulates through the conduit in a forward direction, and the flow control is operative, in a reverse mode, to direct fluid from the supply port of the fluid source into the second end of the conduit and from the first end of the conduit to the return port of the fluid source such that fluid circulates through the conduit in a reverse direction. A mode selector is operative to switch the flow control between forward mode and reverse mode.

In a third embodiment the invention provides a method of circulating fluid to adjust a temperature of a material. The method comprises providing a pressurized fluid source operative to adjust a temperature of a fluid and operative to push the fluid out through a supply port at a supply temperature and operative to draw fluid in through a return port at a return temperature; arranging a conduit in proximity to the material; circulating the fluid from the supply port through the conduit in a forward direction to the return port, and then after an interval of time circulating the fluid from the supply port through the conduit in an opposite reverse direction to the return port; and periodically changing the direction of fluid flow through the conduit between forward and reverse directions.

Thus the invention provides a method and apparatus for periodically reversing the direction of fluid flow through a conduit that is arranged for heat transfer from or to a material. The material located near each end of the conduit thus is exposed to both the supply and return temperatures equally.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labelled with like numbers, and where:

DETAILED DESCRIPTION OF THE ILLUSTRATED EMBODIMENTS

Figure 1:
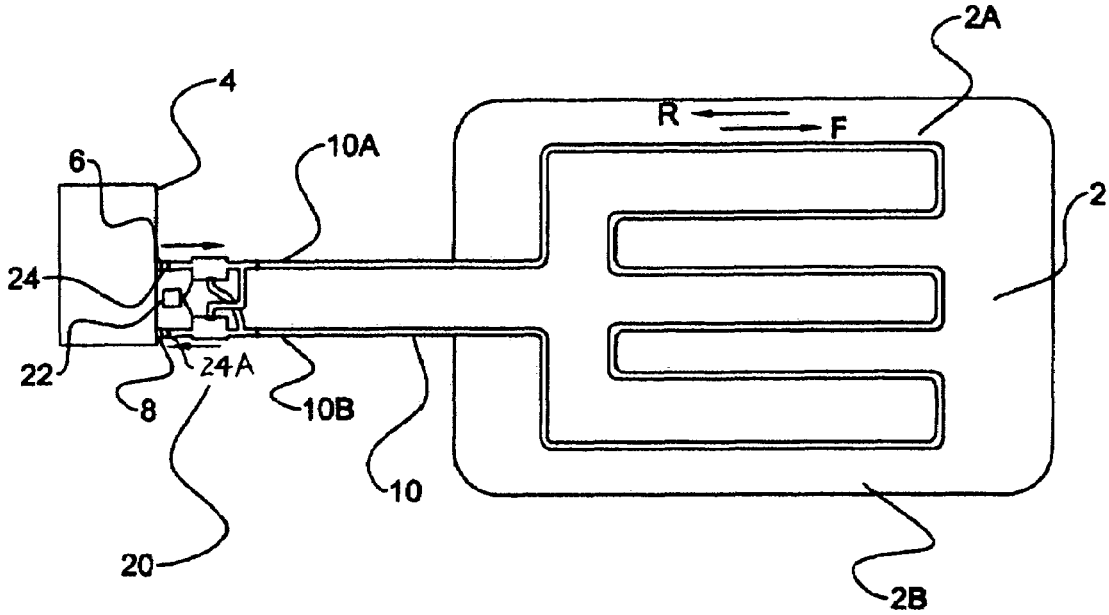
FIG. 1 is a schematic top view of a flow reversing temperature adjusting circulating fluid apparatus of the invention.

FIG. 1 schematically illustrates a circulating fluid apparatus 1 for adjusting the temperature of a material 2. Typical applications would be circulating hot fluid through conduits in a heating panel or floor heating system for heating a building, or through conduits laid in loops on frozen ground for the purpose of thawing the ground for excavation or like purposes. Such systems are also used in curing concrete to maintain the temperature at a suitable temperature when ambient temperatures are either too low or too high by circulating hot or cold fluid, as the case may require.

The apparatus 1 comprises a pressurized fluid source 4 that is operative to adjust a temperature of a fluid and is operative to push the fluid out through a supply port 6 at a supply temperature and draw the fluid back in through a return port 8 at a return temperature.

In a typical heating application, the pressurized fluid source 4 will comprise a boiler or the like, and a circulating pump. A conduit 10 is arranged in proximity to the material 2 such that the temperature of the material will be raised by the warm fluid flowing through the conduit 10. The material could be a radiant heating panel, a floor, frozen ground, concrete, or the like.

Conventionally, the fluid will flow from the supply port 6 at a supply temperature into a conduit 10 at a first end 10A thereof and flow through the conduit to the opposite second end 10B of the conduit 10 and into the return port 8 at a return temperature. As the fluid flows along the conduit 10, heat is transferred from the fluid to the material 2 with result that a temperature gradient is formed along the length of the conduit 10 where the temperature decreases from the first end 10A, where the fluid enters the conduit from the supply port 6 at the supply temperature, to the second end 10B, where the fluid exits the conduit to the return port 8 at a lower return temperature.

The amount of heat that is transferred to the material 2 is directly related to the temperature difference between the fluid and the material 2. The greater the temperature difference the greater the heat transfer. Thus the area 2A near the first end 10A of the conduit 10 receives more heat than the area 2B near the second end 10B of the conduit.

The difference between the supply temperature and the return temperature can be significant. In a typical ground thawing operation where the material 2 is a ground surface for example, the supply temperature could be about 180° F. and the return temperature about 80° F. such that the ground. The ground located at 2A near the first end 10A of the conduit will thus receive much more heat than that at 2B near the second end 10B of the conduit. A temperature gradient will be set up in the material 2 that roughly corresponds to the temperature gradient in the conduit 10, and the ground located at location 2A will thaw much faster than that at location 2B.

Similarly in a concrete curing application in cold weather, the supply temp might be 80° F. and the return temp 40° F. Again a temperature gradient will be set up in the concrete which can adversely affect the strength of the concrete.

Similar temperature gradients form in the material 2 where the material is being cooled by a cold circulating fluid.

To reduce the temperature gradient, the present invention provides a flow control 20 operatively connected to the supply port 6 and the return port 8 of the fluid source 4, and operatively connected to first and second ends 10A, 10B of the conduit 10. The flow control 20 is operative, in a forward mode, to direct fluid from the supply port 6 of the fluid source 4 into the first end 10A of the conduit 10 and from the second end 10B of the conduit 10 to the return port 8 of the fluid source 4, such that the fluid circulates through the conduit 10 in a forward direction indicated by the arrow F.

When the flow control is switched to a reverse mode, it directs fluid from the supply port 6 into the second end 10B of the conduit and directs fluid from the first end 10A of the conduit 10 to the return port 8 of the fluid source 4 such that fluid circulates through the conduit 10 in a reverse direction indicated by the arrow R.

A mode selector 22 is operative to switch the flow control 20 between forward mode and reverse mode. The mode selector could be operated manually, however conveniently the mode selector 22 comprises a timer 21 and switches between forward and reverse modes at a timed interval such that the time the fluid flows in the forward direction F is the same as the time the fluid flows in the reverse direction R. Alternatively, or in addition, first and second temperature sensors 24, 24A can be provided and configured such that the mode selector 22 switches between forward and reverse modes in response to a temperature change. For example in some applications it might be desired to measure the supply and return temperatures and switch modes in response to changes in the difference between the supply and return temperatures.

Thus the flow control 20 periodically reverses the direction of fluid flow through the conduit such that the area 2A and the area 2B receive substantially the same amount of heat from the fluid in the conduit 10 thus reducing the temperature gradient in the material 2.

Figure 2:
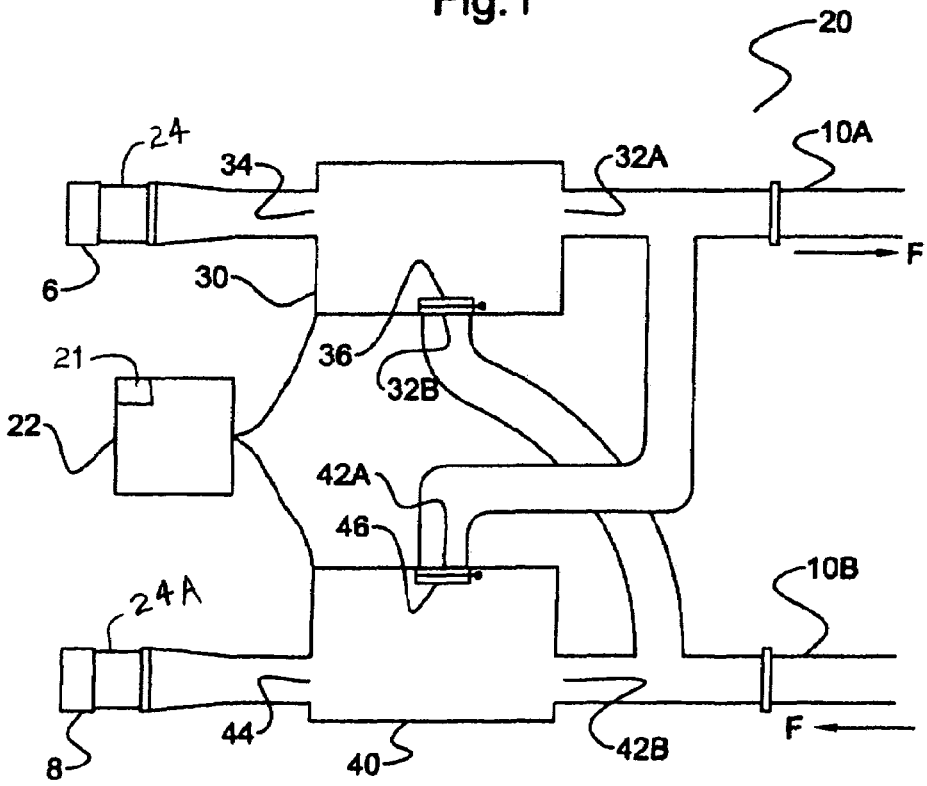
FIG. 2 is a schematic top view of a flow control for reversing the direction of fluid flow shown in a position where fluid flows in a forward direction.

FIG. 2 shows an embodiment of the flow control 20. A supply valve 30 has first and second output ports 32A, 32B operatively connected to respective first and second ends 10A, 10B of the conduit and an input port 34 operatively connected to the supply port 6. The first and second output ports 32A, 32B can be opened or closed by valve stop 36 such that fluid entering the input port 34 moves through the supply valve 30 and out whichever output port 32A, 32B is open to either the first end 10A or the second end 10B of the conduit.

A return valve 40 has first and second input ports 42A, 42B operatively connected to respective first and second ends 10A, 10B of the conduit, and an output port 44 operatively connected to the return port 8. The first and second input ports 42A, 42B can be opened or closed by valve stop 46 such that fluid entering whichever input port 42A, 42B is open, from either the first end 10A or the second end 10B of the conduit, moves through the supply valve 40 and out the input port 44 to the return port 8.

The mode selector 22 is operative to selectively open and close the output ports 32A, 32B on the supply valve 30 and the input ports 42A, 42B on the return valve 40.

As illustrated in FIG. 2, when the flow control 20 is in the forward mode, the first output port 32A of the supply valve 30 is open and the second output port 32B thereof is closed, and the second input port 42B of the return valve 40 is open, and the first input port 42A thereof is closed. Thus fluid flows from the first end 10A of the conduit to the second end 10B in the forward direction F.

Figure 3:
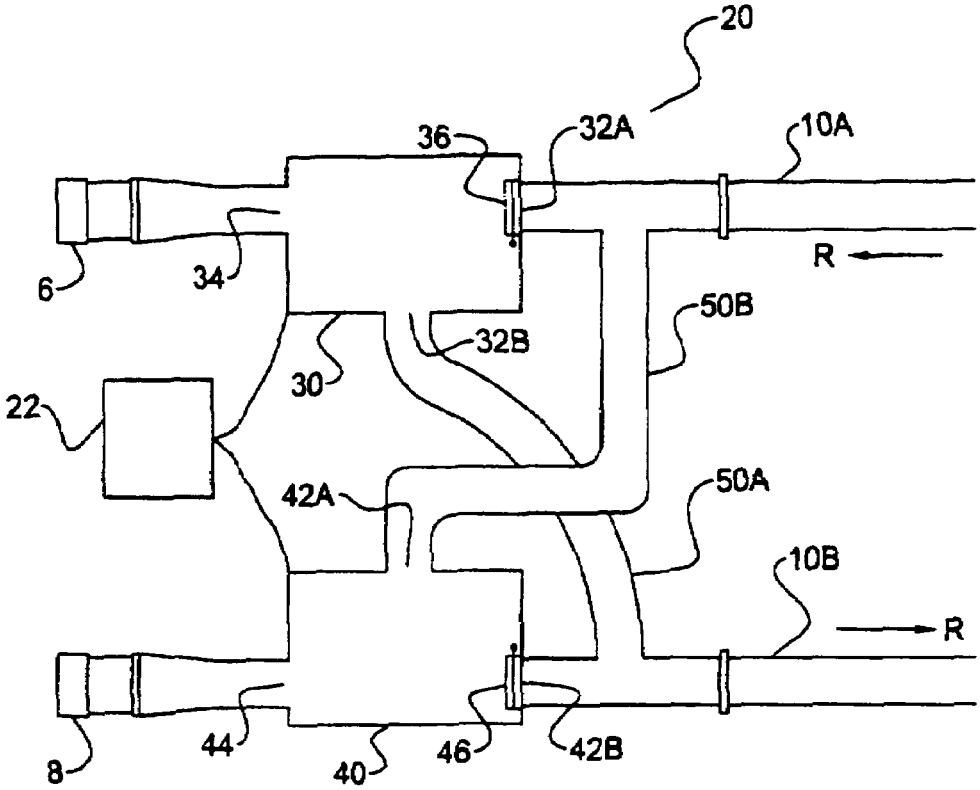
FIG. 3 is a schematic top view of the flow control of FIG. 2 shown in a position where fluid flows in a reverse direction.

As illustrated in FIG. 3, when the flow control 20 is in the reverse mode, the first output port 32A of the supply valve 30 is closed and the second output port 32B thereof is open, and the second input port 42B of the return valve is closed, and the first input port 42A thereof is open. Thus fluid flows from the supply valve 30 through a first crossover tube 50A to the second end 10B of the conduit and through to the first end 10A in the reverse direction R, then through a second crossover tube 50B to the return valve 40 and the return port 8 of the pressurized fluid source.

The mode selector 22 thus opens one port and substantially simultaneously closes the other port on each of the supply and return valves 30, 40 to reverse the direction of fluid flow. Motorized valves and controls for accomplishing this function are well known in the art.

Figure 4:
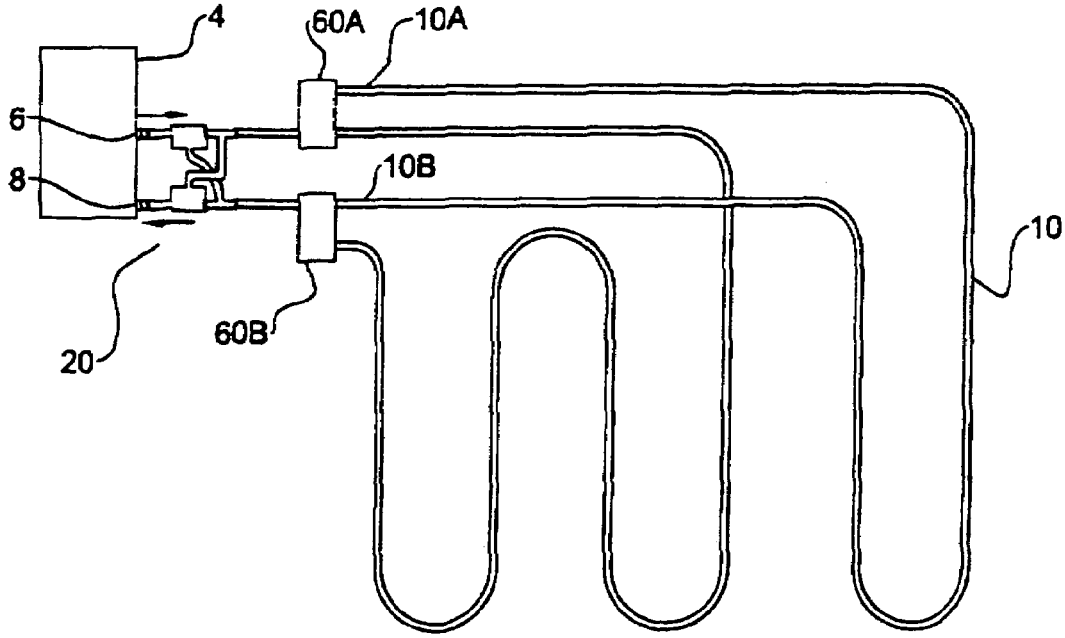
FIG. 4 is a schematic top view of a flow reversing temperature adjusting circulating fluid apparatus of the invention wherein a plurality of conduits are connected to manifolds.

FIG. 4 illustrates a typical application that uses a plurality of shorter conduits 10 connected to first and second manifolds 60A, 60B that are operatively connected to the flow control 20. Again each conduit has a first end 10A operatively connected to the first manifold 60A, and a second end 10B operatively connected to the second manifold 60B such that the first and second ends 10, 10B of each conduit 10 are operatively connected to the flow control 20 through the respective first and second manifolds 60A, 60B. The flow control 20 reverses the direction of fluid flow in the same manner as described above.

Thus the invention provides a method of circulating fluid to adjust a temperature of a material 2 comprising providing a pressurized fluid source 4 operative to adjust a temperature of a fluid and operative to push the fluid out through a supply port 6 at a supply temperature and operative to draw fluid in through a return port 8 at a return temperature. A conduit 10 is arranged in proximity to the material 2, and fluid is circulated from the supply port 8 through the conduit 10 in a forward direction F to the return port 8, and then after an interval of time the fluid is circulated from the supply port 8 through the conduit 10 in a reverse direction R to the return port 8. The direction of fluid flow through the conduit 10 is then periodically changed between forward and reverse directions.

The above illustrates one embodiment of a flow control 20 that can be connected between a conventional pressurized fluid source 4 and a conventional conduit, or manifolds connected to conduits, to provide the required periodic reverse flow to reduce the temperature gradient in the material that is being heated or cooled by the circulating fluid. Those skilled in the art will recognize that other arrangements of valves and controls could readily be adapted for the purpose as well.

The foregoing is thus considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A fluid circulating apparatus for adjusting a temperature of a material, the apparatus comprising:

a pressurized fluid source operative to adjust a temperature of a fluid and operative to push the fluid under pressure out through a supply port at a supply temperature and operative to draw the fluid in through a return port at a return temperature;

a flow control operatively connected to the supply port and the return port of the fluid source;

a conduit having a first end operatively connected to the flow control and a second end operatively connected to the flow control and adapted to be arranged in proximity to the material;

wherein the flow control is operative, in a forward mode, to direct fluid from the supply port of the fluid source into the first end of the conduit and from the second end of the conduit to the return port of the fluid source such that fluid circulates through the conduit in a forward direction;

wherein the flow control is operative, in a reverse mode, to direct fluid from the supply port of the fluid source into the second end of the conduit and from the first end of the conduit to the return port of the fluid source such that fluid circulates through the conduit in a reverse direction; and a mode selector operative to periodically switch the flow control between forward mode and reverse mode during an operation to raise or lower the temperature of the material.

2. The apparatus of claim 1 wherein the flow control comprises:

a supply valve operatively connected to the first and second ends of the conduit and operatively connected to the supply port; and a return valve operatively connected to the first and second ends of the conduit and operatively connected to the return port;

wherein the supply valve is operative to direct fluid from the supply port into the first end of the conduit when the flow control is in the forward mode, and is operative to direct fluid from the supply port into the second end of the conduit when the flow control is in the reverse mode; and wherein the return valve is operative to direct fluid from the second end of the conduit into the return port when the flow control is in the forward mode, and is operative to direct fluid from the first end of the conduit into the return port when the flow control is in the reverse mode.

3. The apparatus of claim 2 wherein:

the supply valve comprises:

an input port operatively connected to the supply port of the fluid source;

first and second output ports operatively connected respectively to the first and second ends of the conduit;

wherein the first and second output ports can be opened or closed such that fluid entering the input port moves through the supply valve and out an open output port; and the return valve comprises:

an output port operatively connected to the return port of the fluid source;

first and second input ports operatively connected respectively to the first and second ends of the conduit;

wherein the first and second input ports can be opened or closed such that fluid entering an open input port moves through the return valve and out the output port.

4. The apparatus of claim 3 wherein the mode selector is operative to selectively open and close the output ports on the supply valve and the input ports on the return valve.

5. The apparatus of claim 4 wherein:

when the flow control is in the forward mode, the first output port of the supply valve is open and the second output port thereof is closed, and the second input port of the return valve is open, and the first input port thereof is closed;

when the flow control is in the reverse mode, the first output port of the supply valve is closed and the second output port thereof is open, and the second input port of the return valve is closed, and the first input port thereof is open.

6. The apparatus of claim 1 further comprising a timer and wherein the mode selector switches between forward and reverse modes at a timed interval.

7. The apparatus of claim 1 further comprising at least one temperature sensor and wherein the mode selector switches between forward and reverse modes in response to a temperature change.

8. The apparatus of claim 7 comprising first and second temperature sensors operative to sense respective first and second temperatures and wherein the mode selector switches between forward and reverse modes in response to changes in a difference between the first and second temperatures.

9. The apparatus of claim 1 further comprising:

first and second manifolds operatively connected to the flow control;

a plurality of conduits each having a first end operatively connected to the first manifold and a second end operatively connected to the second manifold such that the first and second ends of each conduit are operatively connected to the flow control through the respective first and second manifolds.

* * * * *